US008425389B2

(12) United States Patent
Dobrovolsky

(10) Patent No.: US 8,425,389 B2
(45) Date of Patent: Apr. 23, 2013

(54) METHOD AND A SYSTEM FOR MANUFACTURING PRINTED PRODUCTS

(75) Inventor: Sasha Dobrovolsky, San Leandro, CA (US)

(73) Assignee: ePAC Technologies, Inc., San Leandro, CA (US)

( * ) Notice: Subject to any disclaimer, the term of this patent is extended or adjusted under 35 U.S.C. 154(b) by 1264 days.

(21) Appl. No.: 11/345,242

(22) Filed: Feb. 1, 2006

(65) Prior Publication Data

US 2007/0179037 A1 Aug. 2, 2007

(51) Int. Cl.
*B41F 13/58* (2006.01)

(52) U.S. Cl.
USPC ..... 493/324; 493/320; 493/342; 493/356; 493/361; 493/405

(58) Field of Classification Search ..... 493/320, 493/324, 325, 342, 345, 352, 356, 359, 361, 493/362, 405, 416, 458
See application file for complete search history.

(56) References Cited

U.S. PATENT DOCUMENTS 4,146,983 A * 4/1979 Penick et al. ..... 40/124.08
4,212,231 A * 7/1980 Penick et al. ..... 493/344
4,421,501 A * 12/1983 Scheffer ..... 493/439
4,731,142 A * 3/1988 Stenner ..... 156/226
5,405,127 A * 4/1995 Welborn ..... 270/21.1
5,465,213 A 11/1995 Ross
6,334,631 B1 * 1/2002 Hollander ..... 283/56
6,402,132 B1 6/2002 Michaelis et al.
6,953,513 B1 * 10/2005 Volkert ..... 156/256
2002/0061238 A1 5/2002 Marsh
2003/0002955 A1 1/2003 Silberbauer
2003/0044260 A1 3/2003 Grunder et al.

FOREIGN PATENT DOCUMENTS

DE 3720641 A1 6/1987

* cited by examiner

*Primary Examiner* — Christopher Harmon
(74) *Attorney, Agent, or Firm* — Reed Smith LLP

(57) ABSTRACT

For manufacturing books having different sizes and comprising a plurality of text pages constituting a book block, a web of material having a given width is sequentially printed in a digital printing station. The printed web of material is then provided either with one weakening line extending parallel to the longitudinal direction of the web of material or with two weakening lines arranged spaced apart and extending parallel to the longitudinal direction of the web of material. Thereafter the printed web of material is transversely cut to produce individual text sheets which are provided with either one weakening line or two weakening lines. These text sheets are then longitudinally folded along the either one weakening line or in sequence along each of the two weakening lines. The folded text sheets belonging to a particular book block are stacked to a stack. The stacks are either temporarily stored for a later binding process or directly supplied to a binding station.

41 Claims, 2 Drawing Sheets

METHOD AND A SYSTEM FOR MANUFACTURING PRINTED PRODUCTS

BACKGROUND OF THE INVENTION

1. Field of the Invention

The present invention relates generally to processing printed products and more particularly to a method and a system for manufacturing printed products, such as books and parts thereof.

2. Description of the Related Art

Current technologies for folding paper for manufacturing printed products are based on buckle folders, plow folding, knife folding, or a combination thereof.

For buckle folders, the paper sheets are fed into a folder (either in line from the printer, but in most cases in an offline process). Generally, there are two folding processes in use. In the first case, the first fold is 90 degree, across from the paper flow. The next one or two folds are in the direction of the paper flow. With this type of fold, one cannot obtain a flat signature. The first fold is against the paper flow, making it uneconomical to perf the paper in this step. Perfing the sheet (across the web) prior to the initial fold, is also not economical, and will still result in a paper stack that is not as flat. Cutting the signature after folding is another option, but would result in the cost of an additional step and wasted paper.

The other option is to use a buckle folder with a parallel fold. On a parallel fold, the perforations can be performed as an extra step, before or after cutting, but the paper has to change direction before folding. The fastest folders in existence, cannot change the direction of the paper fast enough to account for the speed of the highest speed printers.

Another concept is to use a plow fold, which is on a web, but the equipment needs to be stopped and reset to change to another size paper. On a plow folder, the paper can be perfed in line prior to cutting. The paper goes over one or two upside "plows", and the paper is cut after it is folded. The plow folders allow for high speed folding, but require the folder to stop before the format size can be adjusted, because the process is interrupted. The plow folders require the folding occur prior to the cutting, which makes on the fly changes impossible.

A knife folder is typically used in combination with a plow folder or a buckle folder. In combination with a buckle folder, the same problem of not being able to perf the initial fold exists. In combination with a plow folder, the same problem of changing format sizes exists.

None of the existing technology allows for the creation of a flat signature, with multiple formats, at a high speed. In addition, most of the existing solutions do not allow for folding along the preferred grain direction and do not allow for different cut lengths on the fly.

U.S. published patent application US 2003/0044260 A1 discloses a method and a device for manufacturing books, in which a paper web of a given width is uncoiled from a reel and printed on both sides in a digital printing device. The printed web is then provided with a longitudinal fold extending parallel to the conveying direction. Subsequently the paper web passes through a transverse cutter in which the web is cut into individual sheets. The sheets are supplied to a transverse folding station and provided with a fold extending transversely to the conveying direction of the sheets. The transversely folded sheets are then moved through a longitudinal folding device in which the sheets are folded parallel to the direction of movement.

The printed and folded sheets are fed to a collecting device in which the sheets are collected to book blocks. These book blocks are supplied to an adhesive binding station for adhesively binding together the sheets of a book block at the spine.

SUMMARY OF THE INVENTION

In one aspect of the present invention, a web of material of a given width is sequentially printed in a digital printing station and afterwards transversely cut to produce individual text sheets. The text sheets are longitudinally folded along either one folding line extending parallel to the longitudinal direction of the web of material or in sequence along two folding lines arranged spaced apart and extending parallel to the longitudinal direction of the web of material. The folded text sheets which belong to a particular book block are collected to a stack. Preferably, the stacks of folded text sheets are temporarily stored and at a later stage supplied to a binding station. As an alternative, the stacks of folded text sheets can be supplied from a stacking station directly to a binding station.

Prior to transversely cutting the web of material, the web of material is preferably provided either with one weakening line extending parallel to the longitudinal direction of the web of material and defining the one folding line or with two weakening lines arranged spaced apart and extending parallel to the longitudinal direction of the web of material and defining the two folding lines. The weakening lines may be perforation lines or crease lines.

According to one embodiment of the present invention, a first predetermined number of text sheets are folded along the one folding or weakening line and subsequently a second predetermined number of text sheets are folded in sequence along the two folding or weakening lines. Preferably, the change-over from folding the web of material along the one folding or weakening line to folding the web of material along the two folding or weakening lines takes place while the web of material is moving.

According to a still further embodiment of the present invention, a first predetermined number of text sheets are folded in sequence along the two folding or weakening lines and subsequently a second predetermined number of text sheets are folded along the one folding or weakening line. Preferably, the change-over from folding the web of material along the two folding or weakening lines to folding the web of material along the one folding or weakening line takes place while the web of material is moving.

According to a further aspect of the present invention, the web of material is first provided with the one weakening line along a first predetermined length of the web. Subsequently the web of material is provided with the two weakening lines along a second predetermined length of the web. Preferably, the change-over from providing the web of material with the one weakening line to providing the web of material with the two weakening lines takes place while the web of material is moving.

In a still further embodiment the web of material is first provided with the two weakening lines along a first predetermined length of the web. Subsequently the web of material is provided with the one weakening line along a second predetermined length of the web. Preferably, the change-over from providing the web of material with the two weakening lines to providing the web of material with the one weakening line takes place while the web of material is moving.

Preferably, the text sheets of each stack forming a book block are adhesively bound together at the spine of the book block.

According to another aspect of the present invention, the sheets of a book block are trimmed along at least one edge of the book block, preferably along three edges of the book block.

According to a still further embodiment of the present invention, a system for manufacturing books having different sizes and a plurality of text pages constituting a book block is provided which comprises a web supply station for supplying a web of material of a given width, a digital printing station for sequentially printing the web of material at least on one side with text, a transverse cutting device for transversely cutting the printed web of material to produce individual text sheets, a longitudinal folding station for longitudinally folding the text sheets along either one folding line extending parallel to the longitudinal direction of the web of material or in sequence along two folding lines arranged spaced apart and extending parallel to the longitudinal direction of the web of material, and a stacking station for stacking the folded printed sheets belonging to a particular book block to form a stack.

Preferably the system further comprises a processing station for providing the printed web of material either with one weakening line extending parallel to the longitudinal direction of the web of material and defining a folding line or with two weakening lines arranged spaced apart and extending parallel to the longitudinal direction of the web of material and defining two folding lines. The processing station is arranged upstream of the transverse cutting station.

In a preferred embodiment the system further comprises a binding station, in particular an adhesive binding station, for binding together the text sheets of a stack forming a book block.

In a further aspect of the present invention a buffer or storage location for temporarily storing the stacks prior to binding is provided.

According to a further embodiment of the present invention the system comprises a trimming station for trimming the sheets of a book block along one or more edges of the book block.

Preferably, the web supply station comprises an uncoiling device for uncoiling the web of material rolled onto a reel.

In general, the present invention provides for longitudinally folding the text sheets cut from a printed web of material either along one folding or weakening line extending parallel to the longitudinal direction of the web of material or in sequence along two folding or weakening lines arranged spaced apart and extending parallel to the longitudinal direction of the web of material. The length of the text sheets cut from the web of material can be varied. Thus, the method and the system according to the present invention allows the production of books having different sizes starting with a web of material having a given width.

The stacks of folded sheets belonging to the same book block can be buffered or temporarily stored prior to the binding operation.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

The following description is provided to enable any person skilled in the art to make and use the invention and sets forth the best modes contemplated by the inventor for carrying out the invention. Various modifications, however, will remain readily apparent to those skilled in the art. Any and all such modifications, equivalents and alternatives are intended to fall within the spirit and scope of the present invention.

Figure 1:
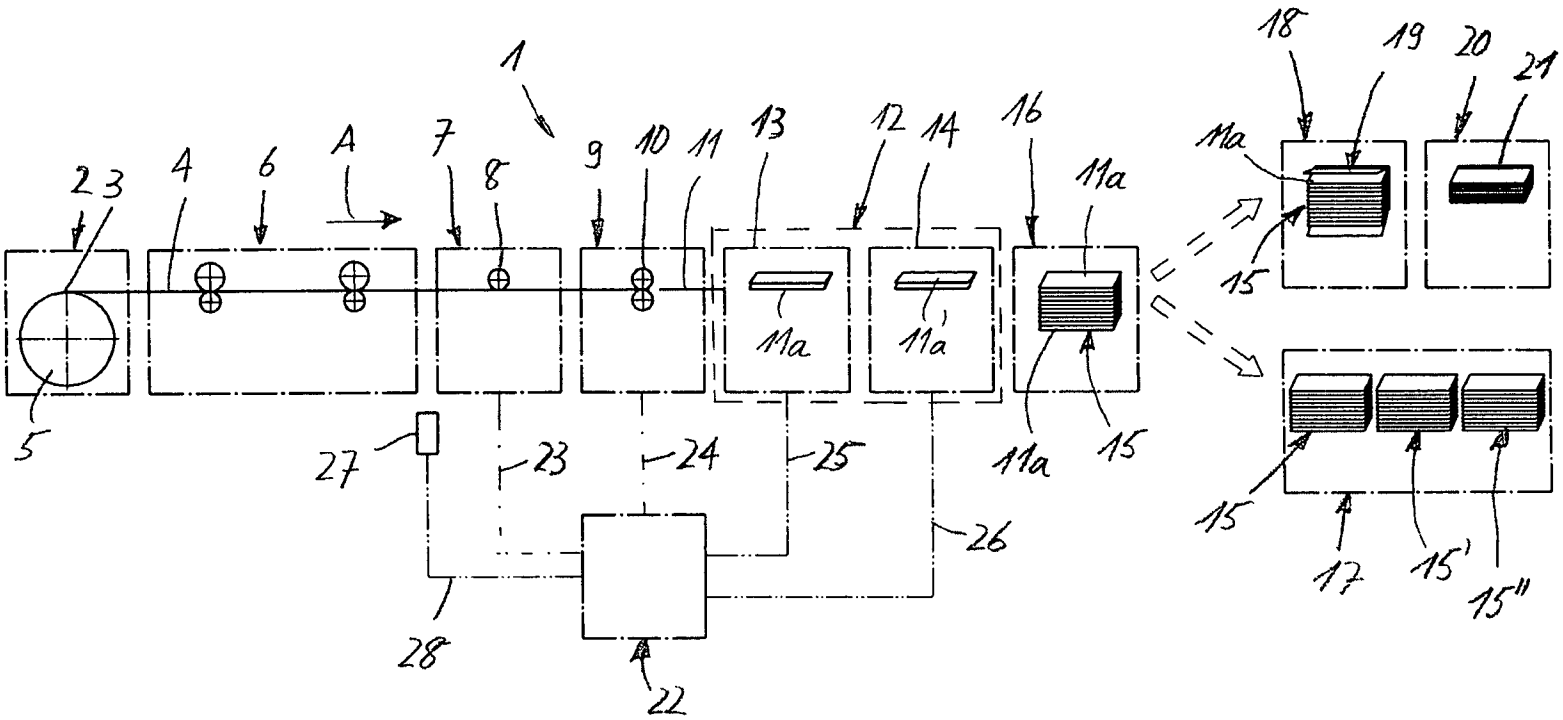
FIG. 1 is a schematic illustration of a system for manufacturing books having different sizes according to the present invention.

FIG. 1 shows schematically a system 1 for producing books of different sizes.

In the direction A of the processing process this system 1 comprises a web supply station 2 which is provided with an uncoiling device 3 for uncoiling a web of material 4, preferably a paper web, which is rolled onto a reel 5. The web of material 4 uncoiled from reel 5 is transported through a digital printing station 6 in which the web of material 4 is digitally and sequentially printed on both sides. Downstream of the printing station 6 a processing or perforating station 7 is arranged. The perforating station 7 comprises a perforating unit 8 which serves to provide the printed web of material 4 moving through the processing or perforating station 7 with either one weakening line or two weakening lines as it will be explained later in connection with FIG. 2. Following the processing or perforating station 7 a transverse cutting station 9 is provided which includes a transverse cutting unit 10 which transversely cuts the web of material 4 to produce individual text sheets 11. Downstream of the cutting station 9 a longitudinal folding station 12 is arranged which comprises a first folding device 13 and a second folding device 14. As will be explained later in greater detail in connection with FIG. 2, the flat text sheets 11 are longitudinally folded either once along the one weakening line in the first folding device 12 or twice along the two weakening lines in the second folding device 14. The folded text sheets 11*a* are stacked to a stack 15 in a stacking station 16 which is arranged downstream of the folding station 12.

A buffer or storage location 17 and a binding station 18 are arranged downstream of the stacking station 16. The stacks 15 are transported either to the buffer or storage location 17 for a temporary storage prior to a binding operation or to the binding station 18 in which the folded text sheets 11*a* of a stack 15 are bound together and a cover 19 is attached. Following the binding station 18 a trimming station 20 is arranged. This trimming station 20 serves to trim a bound book 21 along three edges.

The system 1 is controlled by a control device 22 to which various stations of the system 1 are connected. In FIG. 1, only the connections 23, 24, 25 and 26 to the perforating station 7, the transverse cutting station 9 and the first and second folding is devices 13 and 14 are shown. A reader or sensor 27 is connected to the control device 22 via a connection 28. The reader or sensor 27 is arranged at the output side of the digital printing station 6 and reads or detects control or information marks B (FIG. 2) which are provided on the web of material 4. Based on the signals which the control device 22 receives from the reader or sensor 27 the operation of the perforating unit 8 of the perforating station 7, the operation of the transverse cutting unit 10 of the transverse cutting station 9 as well as the operation of the first and second folding devices 13, 14 of the longitudinal folding station 12 are controlled as it will be explained in greater detail in connection with FIG. 2.

Figure 2A:
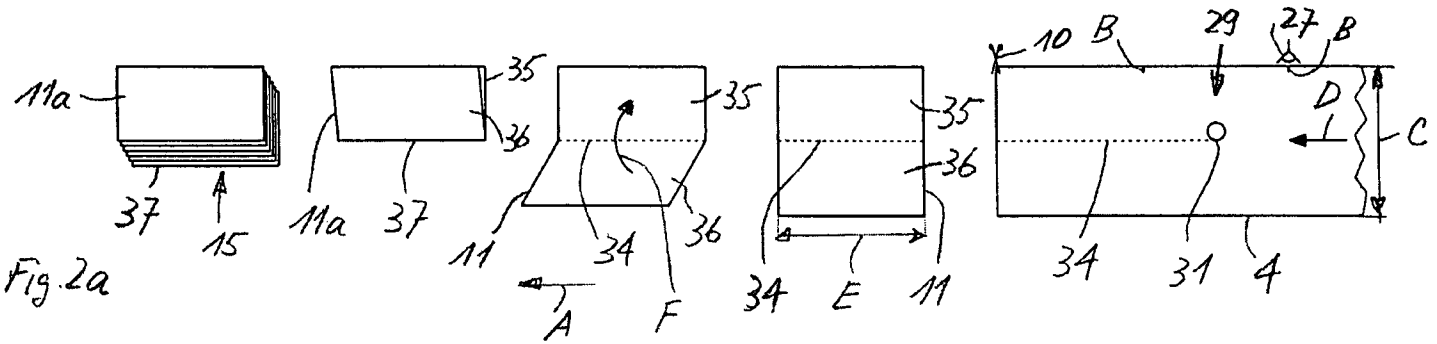
FIG. 2*a*-2*c* illustrate schematically the method of producing stacks of folded sheets of different sizes according to the present invention.
Figure 2B:
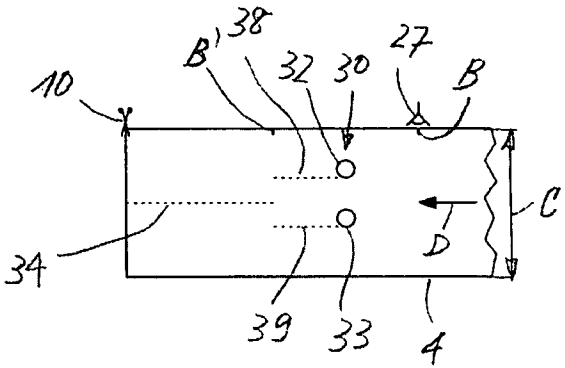
Figure 2C:
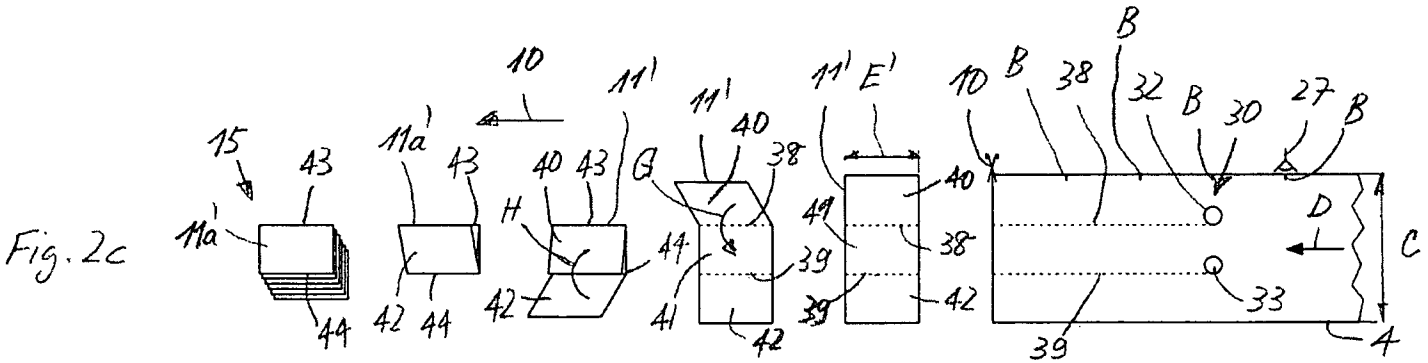

The perforating unit 8 comprises a first perforating device 29 and a second perforating device 30 which are schematically depicted in FIG. 2. The first perforating unit 29 comprises a single perforating wheel 31 (FIG. 2*a*), whereas the second perforating device 30 comprises two perforating wheels 32, 33 (FIGS. 2*b* and 2*c*). The control device 22 to which the processing or perforating station 7 and its perforating unit 8 are connected alternatively activates either the first perforating device 29 or the second perforating device 30.

The operation of the system 1 shown in FIG. 1 will now be described in greater detail in connection with FIG. 2. FIG. 2*a* illustrates the production of text sheets which are folded once and constitute four book pages, whereas the production of folded text sheets which are folded twice and constitute six book pages is shown in FIG. 2*c*. The transition or change-over from the production of folded sheets constituting four book pages to the production of folded text sheets constituting six book pages is illustrated in FIG. 2*b*.

The web of material 4 which has a given width C is sequentially printed on both sides with text and/or illustrations in the digital printing station 6. This printing process is known per se. The control or information marks B are also printed on the web of material 4 in the digital printing station 6.

The printed web of material 4 is moved in its longitudinal direction D which is parallel to the processing direction A past the reader or sensor 27 to the processing or perforating station 7. The reader or sensor 27 senses or reads the control or information marks B printed on the web of material 4 and produces corresponding control signals which are processed in the control device 22 which in turn controls the various stations and devices connected to it.

In case text sheets are to be produced constituting four book pages as illustrated in FIG. 2*a* the control device 22 causes the first perforating device 29 to be activated. This means that the single perforating wheel 31 of this first perforating device 29 is in action. Furthermore the control device 22 activates the first folding device 13. The printed web of material 4 passing through the activated first perforating device 29 is provided by the perforating wheel 31 with a single perforation or weakening line 34 which runs parallel to the longitudinal direction D of the web of material 4.

In the following step the web of material 4 provided with the one perforation or weakening line 34 is transversely cut by the transverse cutting unit 10 of the cutting station 9 to produce individual flat text sheets 11. In FIG. 2*a* (as well as in FIGS. 2*b* and 2*c*) this cutting unit 10 is schematically represented by a pair of scissors. The text sheets 11 have a given length E which can be varied by controlling the cutting cycles of the cutting unit 10 by the control device 10. The perforation line 34 divides the text sheets 11 into two sections 35 and 36.

The text sheets 111 cut from the web of material 4 and having a single perforation line 34 are then transported to the longitudinal folding station 12 and folded once in the first folding device 13 along the perforation line 34 as indicated by arrow F. The resulting folded text sheets 11*a* are provided with a fold 37 coinciding with the perforation line 34.

The folded text sheets 11*a* pass through the inactive second folding device 14 and are then stacked in a stack 15 in the stacking station 16.

As explained earlier in connection with FIG. 1, the stacks 15 each of which constitutes a book block are either transported to the buffer or storage location 17 or to the binding station 18. The stacks temporarily stored in the buffer or storage location 17 are later transported to a binding and trimming station.

Now the production of text sheets constituting six book pages as illustrated in FIG. 2*c* is described. In this case the control device 22 causes the second perforating device 30 to be activated. This means that the pair of perforating wheels 32, 33 of this second perforating device 30 are in action. Furthermore the control device 22 activates the second folding device 14.

The printed web of material 4 passing through the activated second perforating device 30 is provided by the two perforating wheels 32, 33 with two perforation or weakening lines 38, 39 which are spaced apart and run parallel to the longitudinal direction D of the web of material 4.

Next the web of material 4 provided with the two perforation or weakening lines 38 and 39 is transversely cut by the transverse cutting unit 10 of the cutting station 9 to produce individual flat text sheets 11'. The text sheets 11' have a given length E' which can also be varied by controlling the cutting cycle of the cutting unit 10 by the control device 22. The perforation lines 38 and 39 divide the text sheet 11 into three sections 40, 41 and 42.

The text sheets 11' cut from the web of material 4 and having two parallel perforation or weakening lines 38, 39 are transported through the now inactive first folding device 13 to the second folding device 14. In this second folding device 14 the text sheets 11' are first folded along the perforation line 38 as indicated by arrow G. Thereby the sheet section 40 is folded onto the sheet section 41. Thus a first fold 43 coinciding with the perforation line 38 is created.

In a subsequent step the text sheet 11' is folded again but this time along the other perforation line 39 as indicated by arrow H. By this folding operation the sheet section 42 is folded onto the sheet section 40. Thereby a second fold 44 is created which coincides with the other perforation line 39.

The twice folded text sheets 11*a*' are moved to the stacking station 16 and stacked in a stack 15. The stacks 15 each of which constitutes a book block are either transported to the buffer or storage location 17 prior to the binding operation or directly to the binding station 18 as explained earlier in connection with FIG. 1.

The transition or change-over from the production of folded sheets 11*a* constituting four book pages to the production of folded text sheets 11*a*' constituting six book pages can take place while the web of material 4 is moving as it is shown in FIG. 2*b*.

First, the first perforating device 29 and the first folding device 13 are activated as explained earlier in connection with FIG. 2*a* to produce text sheets 11 which are folded once. When this production job is finished and a change to another production job calling for producing text sheets which are folded twice is required, the digital printing station 6 prints a respective control mark B' (FIG. 2*b*) on the web of material 4. When this particular control mark B' is read or sensed by the reader or sensor 27, the first perforating device 29 and the first folding device 13 are deactivated at the appropriate moment and in turn the second perforating device 30 and the second folding device 14 are activated. Now, the web of material 4 is provided with the two perforation lines 38 and 39 as illustrated in FIG. 2*b*.

The change-over from the production of folded sheets 11*a*' constituting six book pages back to the production of folded text sheets 11*a* constituting four book pages takes place in the same manner as explained above.

It should be noted that the text sheets 11*a* folded once and the text sheets 11*a*' folded twice are produced from the same web of material 4 having a given width C. This means that the width of the text sheets 11*a* folded once is larger than the width of the text sheets 11*a*' folded twice. As explained earlier, the length E, E' of the folded text sheets 11*a*, 11*a*' can also be varied by controlling the length of the cutting cycles of the transverse cutting unit 10 accordingly. As a result, the system 1 described allows the production of stacks 15 and therefore also of books 21 having different sizes.

Since the text sheets 11*a*, 11*a*' are folded prior to stacking the text sheets 11*a*, 11*a*' can be stacked properly so that the text sheets 11*a*, 11*a*' of a stack 15 are perfectly aligned with each other on all four sides of the stack 15 which allows the proper binding of the text sheets 11*a*, 11*a*' of a book block at the spine of the book. Furthermore, these stacks 15 are stable and can be transported and otherwise handled without falling apart.

The folds 37, 43, 44 do not have any detrimental effects on the finished book 21. If these folds 37, 43, 44 are arranged at that side of a stack 15 which later becomes the spine of the book, these folds 37, 43, 44 are removed during the binding of the text sheets 11*a*, 11*a*'. The folds 37, 43, 44 arranged at one of the other sides of the stack 15 are cut away during the trimming of the book block in the trimming station 20.

Various modifications of the system 1 shown and described above are conceivable, some of which will now be referred to.

Instead of beginning with the production of text sheets 11*a* folded once as described in connection with FIG. 2*a*, it is also possible to start with the production of text sheets 11*a*' folded twice as explained in connection with FIG. 2*c* and switch later to the production of text sheets 11*a* folded once.

Instead of controlling various stations and devices of the system 1 by signals produced by the reader or sensor 27 reading control marks B printed on the web of material 4 as explained above, the stations and devices can also be controlled by a system control which electronically controls the entire system 1, including the digital printing station 6.

It is also possible to provide the web of material 4 with crease lines instead of perforation lines 34, 38, 39 to produce the weakening lines required for a proper folding of the text sheets 11, 11'.

Those skilled in the art will appreciate that various adaptations and modifications of the preferred embodiments described above can be configured without departing from the scope and spirit of the invention. Therefore, it is to be understood that, within the scope of the appended claims, the invention may be practised other than as specifically described herein.

What is claimed is:

1. A method of manufacturing printed products, such as books having different sizes wherein each book comprises a plurality of text pages constituting a book block, the method comprising:

sequentially printing a web of material having a given width and having a longitudinal direction in a digital printing station;

selecting to process the web of material with either with one weakening line extending parallel to a longitudinal direction of the web of material or with two weakening lines arranged spaced apart and extending parallel to the longitudinal direction of the web of material, wherein the selecting is based on a size of a printed product currently being printed;

transversely cutting the printed web of material to produce individual text sheets being provided with the either one weakening line or the two weakening lines;

longitudinally folding the text sheets along the either one weakening line or in sequence along each of the two weakening lines; and collecting the folded text sheets belonging to a particular book block to a stack.

2. The method according to claim 1, wherein the stacks are temporarily stored.

3. The method according to claim 1, wherein the stacks are supplied to a binding station.

4. The method according to claim 1, wherein the weakening lines are perforation lines.

5. The method according to claim 1, wherein the web of material is printed on both sides.

6. The method according to claim 1, wherein the web of material is first provided with one weakening line along a first predetermined length of the web when manufacturing a first printed product, and subsequently the web of material is provided with the weakening lines along a second predetermined length of the web when manufacturing a second printed product.

7. The method according to claim 6, wherein the changeover from providing the web of material with the one weakening line to providing the web of material with the two weakening lines takes place while the web of material is moving.

8. The method according to claim 6, wherein a first predetermined number of text sheets are folded along the one weakening line and subsequently a second predetermined number of text sheets are in sequence folded along the two weakening lines.

9. The method according to claim 8, wherein the changeover from folding the web of material along the one weakening line to folding the web of material along the two weakening lines takes place while the web of material is moving.

10. The method according to claim 1, wherein the web of material is first provided with two weakening lines along a first predetermined length of the web when manufacturing a first printed product, and subsequently the web of material is provided with one weakening line along a second predetermined length of the web when manufacturing a second printed product.

11. The method according to claim 10, wherein the changeover from providing the web of material with the two weakening lines to providing the web of material with the one weakening line takes place while the web of material is moving.

12. The method according to claim 10, wherein a first predetermined number of text sheets are in sequence folded along the two weakening lines and subsequently a second predetermined number of text sheets are folded along the one weakening line.

13. The method according to claim 12, wherein the changeover from folding the web of material along the two weakening lines to folding the web of material along the one weakening line takes place while the web of material is moving.

14. The method according to claim 1, wherein the text sheets of each stack forming a book block are adhesively bound together at the spine of the book block.

15. The method according to claim 1, wherein the sheets of a book block are trimmed along one or more edges of the book block.

16. A method of manufacturing printed products, such as books having different sizes wherein each book comprises a plurality of text pages constituting a book block, the method comprising:

moving a web of material having a given width through a digital printing station in a first conveying direction;

sequentially printing the web of material in the digital printing station;

further moving the printed web in the first conveying direction through a processing station for providing longitudinal weakening lines in the web of material;

selecting to process the printed web of material in the processing station either with one weakening line extending parallel to the first conveying direction of the web of material or with two weakening lines arranged spaced apart and extending parallel to the first conveying direction of the web of material, wherein selecting to process with one weakening line or two weakening lines depends on a size of a printed product currently being printed;

further moving the printed web of material provided with either one weakening line or two weakening lines through a transverse cutting station in the first conveying direction;

transversely cutting the printed web of material in the transverse cutting station to produce individual text sheets being provided with either one weakening line or two weakening lines;

moving the text sheets through a longitudinal folding station, longitudinally folding the text sheets in the longitudinal folding station along the either one weakening line or in sequence along each of the two weakening lines;

moving the folded text sheets to a stacking station; and stacking the folded printed sheets belonging to a particular book block in the stacking station to form a stack.

17. The method according to claim 16, wherein the stacks are temporarily stored in a buffer or storage location.

18. The method according to claim 16, wherein the stacks are supplied to a binding station.

19. The method according to claim 16, wherein the weakening lines are perforation lines.

20. The method according to claim 16, wherein the web of material is printed in the printing station on both sides.

21. The method according to claim 16, wherein in the processing station the web of material is first provided with the one weakening line along a first predetermined length of the web and subsequently the web of material is provided with the two weakening lines along a second predetermined length of the web.

22. The method according to claim 21, wherein the changeover from providing the web of material with the one weakening line to providing the web of material with the two weakening lines takes place while the web of material is moving.

23. The method according to claim 21, wherein in the longitudinal folding station a first predetermined number of text sheets are folded along the one weakening line and subsequently a second predetermined number of text sheets are in sequence folded along the two weakening lines.

24. The method according to claim 23, wherein the changeover from folding the web of material along the one weakening line to folding the web of material along the two weakening lines takes place while the web of material is moving.

25. The method according to claim 16, wherein in the processing station the web of material is first provided with the two weakening lines along a first predetermined length of the web and subsequently the web of material is provided with the one weakening line along a second predetermined length of the web.

26. The method according to claim 25, wherein the changeover from providing the web of material with the two weakening lines to providing the web of material with the one weakening line takes place while the web of material is moving.

27. The method according to claim 25, wherein in the longitudinal folding station a first predetermined number of text sheets are in sequence folded along the two weakening lines and subsequently a second predetermined number of text sheets are folded along the one weakening line.

28. The method according to claim 27, wherein the changeover from folding the web of material along the two weakening lines to folding the web of material along the one weakening line takes place while the web of material is moving.

29. The method according to claim 18, wherein in the binding station the text sheets of each stack forming a book block are adhesively bound together at the spine of the book block.

30. The method according to claim 16, wherein the sheets of a book block are trimmed along one or more edges of the book block in a trimming station.

31. A system for manufacturing printed products, such as books having different sizes wherein each book comprises a plurality of text pages constituting a book block, the system comprising:

a web supply station for supplying a web of material having a given width and having a longitudinal direction;

a digital printing station for sequentially printing the web of material at least on one side with text;

a processing station for providing the printed web of material either with one weakening line extending parallel to the longitudinal direction of the web of material or with two weakening lines arranged spaced apart and extending parallel to the longitudinal direction of the web of material, wherein providing the web of material with one weakening line or two weakening lines comprises selecting one weakening line or two weakening lines based on a size of a printed product currently being printed;

a transverse cutting station for transversely cutting the printed web of material to produce individual text sheets being provided with either one weakening line or two weakening lines;

a longitudinal folding station for longitudinally folding the text sheets along the either one weakening line or in sequence along each of the two weakening lines; and a stacking station for stacking the folded printed sheets belonging to a particular book block to form a stack.

32. The system according to claim 31, further comprising a binding station for binding together the text sheets of a stack forming a book block.

33. The system according to claim 31, further comprising a buffer or storage location for temporarily storing the stacks.

34. The system according to claim 32, wherein the binding station is an adhesive binding station for adhesively binding together the text sheets of a stack forming a book block at the spine of the book block.

35. The system according to claim 31, wherein the processing station is a perforating station.

36. The system according to claim 31, further comprising a trimming station for trimming the sheets of a book block along one or more edges of the book block.

37. The system according to claim 31, wherein the web supply station comprises an uncoiling device for uncoiling the web of material rolled onto a reel.

38. The system according to claim 31, wherein the longitudinal folding station comprises a first folding device for longitudinally folding the text sheets provided with the one weakening line and a second folding device for folding the text sheets provided with the two weakening lines.

39. The system according to claim 35, wherein the perforating station comprises a first perforating device for providing the web of material with the one weakening line and a second perforating device for providing the web of material with the two weakening lines.

40. The system according to claim 39, wherein the first perforating device comprises one perforating wheel.

41. The system according to claim 39, wherein the second perforating device comprises two perforating wheels which are spaced apart transverse to the longitudinal direction of the web of material.

* * * * *